United States Patent [19]

Gallusser et al.

[11] 4,272,149

[45] Jun. 9, 1981

[54] ONE PIECE SOCKET TYPE ELECTRICAL CONTACTS

[75] Inventors: David O. Gallusser, Oneonta; Valentine J. Hemmer, Sidney; Gary C. Toombs, New Berlin, all of N.Y.

[73] Assignee: The Bendix Corporation, Southfield, Mich.

[21] Appl. No.: 79,764

[22] Filed: Sep. 28, 1979

[51] Int. Cl.[3] ..... H01R 13/428

[52] U.S. Cl. ..... 339/258 R; 339/217 S

[58] Field of Search ..... 339/217 S, 176, 256 R, 339/258 R, 278 T, 97 R

[56] References Cited

U.S. PATENT DOCUMENTS

| | | | |
|---|---|---|---|
| 2,291,434 | 7/1942 | Hollopeter et al. | 339/97 R |
| 3,588,789 | 6/1971 | Kailus | 339/217 S |
| 3,641,483 | 2/1972 | Bonhomme | 339/217 S |
| 3,998,518 | 12/1976 | Mathe | 339/217 S |

OTHER PUBLICATIONS

AMP Catalog No. 73-204, pp. 9-164 and 9-166.

*Primary Examiner*—John McQuade

*Attorney, Agent, or Firm*—Richard V. Westerhoff; Raymond J. Eifler; C. Dennis Lacina

[57] ABSTRACT

One piece socket (1) or pin type (37) electrical contacts are stamped from a sheet of resilient, electrically conductive material and rolled into a tubular body (3) having a center section (11, 39) of enlarged diameter which functions as a C spring and is radially compressed to insert or remove the contact from either the front or rear of a bore (33, 41) in a connector (31, 45). An annular groove (17, 47) in the center section (11, 39) engages a retention ring (35, 49) in the bore (33, 41) to lock the contact (1, 37) in place and the center section (11, 39) bears against the wall of the bore (33, 41) to stabilize the connection. The resilient fingers (19) forming the socket type contact (1) taper inward and then flare outward to form a funnel (21) which guides the pin (53) of a mating pin type contact (37) into a narrow neck (55) in the socket where it is wiped clean and firmly gripped. The contacts (1, 37) may be provided with conventional terminations or with a self-terminating wire well having tines (25) and ribs (27) which cooperate to grip a stripped or unstripped wire which is first longitudinally pushed into and then pulled back toward the wire receiving end of the contact (1, 37).

2 Claims, 3 Drawing Figures

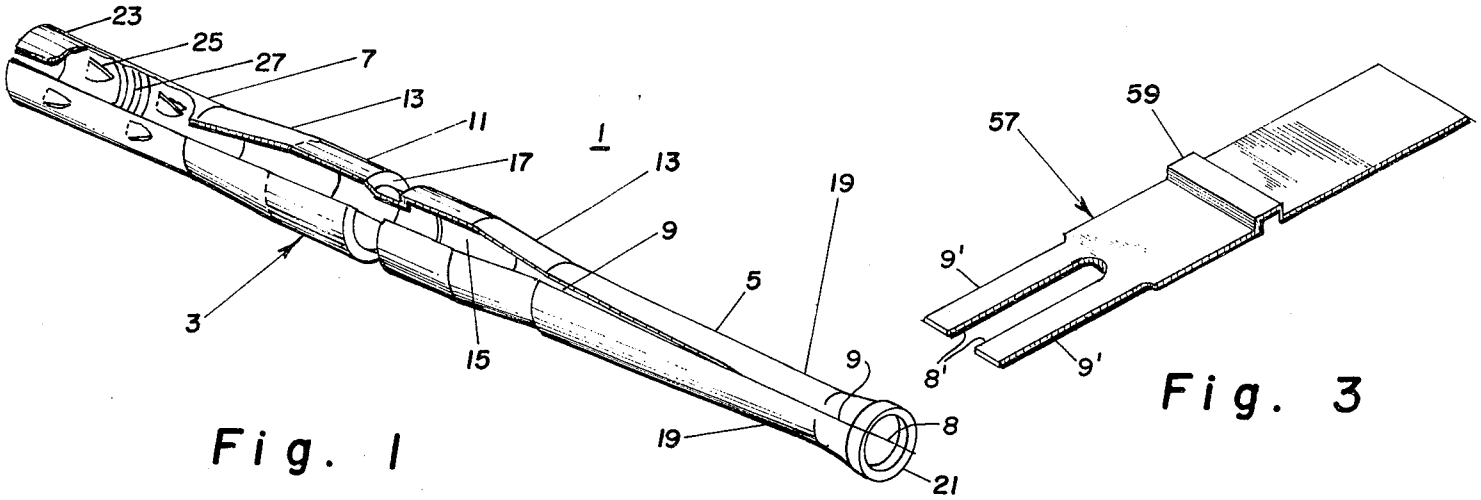
Fig. 1
Fig. 3
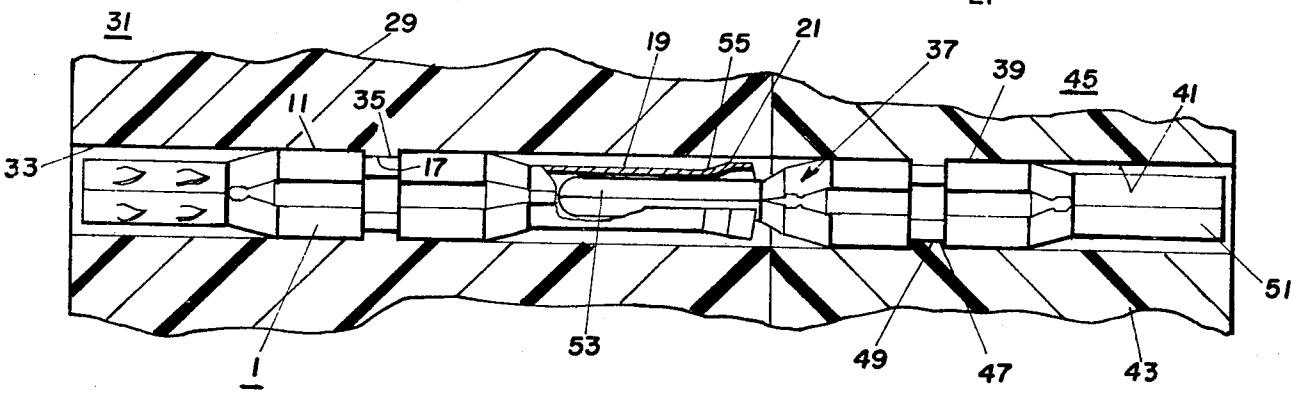
Fig. 2

ONE PIECE SOCKET TYPE ELECTRICAL CONTACTS

BACKGROUND OF THE INVENTION

1. Field of the Invention

This invention relates to electrical contacts and, more specifically, to socket and pin type contacts which are removably retained in connectors used to interconnect multiple leads in an electrical system.

2. Prior Art

It is common practice to interconnect numerous leads in an electrical system with socket and pin type contacts grouped together in a common connector. Generally, the contacts are removably retained in the connector by various mechanisms so that the individual contacts can be replaced or eliminated as the need arises. Some contacts are provided with an annular projection while others have an annular groove or recess which cooperates with rings, shoulders, webs or fingers within the connector to retain the contact in the connector. Many of the retaining mechanisms require a special tool for releasing the contact. In some cases the contact can only be inserted and removed from one end, or is released by inserting a tool from one end and removing the contact from the other.

With the developments in miniaturization of electrical system components and the increase in system complexity, there is a trend in the field to reduce the size of socket and pin type electrical contacts. It is common practice to machine the miniature contacts, especially those incorporating an annular retention groove. However, machining is expensive and hence interest has developed in stamping and rolling contacts from sheet material. Unfortunately, the advantages of economy to be gained from stamping and rolling are offset in many of these newer contacts by the inclusion of one or more sleeves over a stamped and rolled liner to provide strength and protection for the liner and to provide the retention element which can not always be easily formed by stamping and rolling.

It is a primary object of the present invention to provide a one piece stamped and rolled socket or pin type electrical contact.

It is another object of the invention to provide such an electrical contact which can be inserted, and released and removed from either end of the connector.

It is also an important object of the invention to provide an electrical contact of the type described in the previous objects which is stable in the connector.

It is yet another object of the invention to provide an electrical contact of the type described in any of the previous objects which is self-terminating in that no crimping, soldering, welding or wrapping is required to secure the electrical lead to the contact.

SUMMARY OF THE INVENTION

According to the invention, a one piece electrical contact (1) is stamped and rolled from a sheet of electrically conductive material into a tubular body (3) having a longitudinal seam (9). The tubular body (3) has a mating portion (5) at one end and a wire receiving portion (7) at the other end, with a center section (11) of larger diameter than either of the end portions. The center section is joined to the mating and wire receiving portions by tapered sections (13) of the tubular body and is provided with an annular groove (17) which mates with an annular retaining ring (35) projecting into the bore (33) of a connector (31) to removably lock the contact (1) in the connector (31). The center section (11) of the tubular body (3) is radially compressible so that the contact (1) can slide axially into a position within the bore (33) of the connector (31) where the annular groove (17) on the center section (11) is aligned with the retaining ring (35) in the bore (33). The resilient center section (11) then expands to bear against the walls of the connector bore (33) and give the contact stability. A gap (15) is provided in the longitudinal seam (9) of the tubular body (3) in the area of the tapered sections (13) and the center section (11) so that these sections may be compressed to reduce their cross-section during installation and removal of the contact (1). Since a tapered section (13) of the tubular body (3) is provided at each end of the center section (11) which incorporates the retainer groove (17), the contact (1) can be inserted from, and released and removed from, either end of the bore (33) in the connector (31). A cylindrical tool having an outer diameter smaller than the inner diameter of the retaining ring (35) in the connector is inserted into either end of the bore (33) so that it slides up the adjacent tapered section (13) of the contact to compress the center section (11) and disengage the annular groove (17) on the center section (11) from the retainer ring (35).

The contact can be provided with a conventional wire termination or with a unique self-terminating wire receiving portion (7). The latter includes a number of tines (25) which project radially inward and axially toward the center section from the internal wall of the tubular wire receiving portion (7). These tines (25), which are made of electrically conductive material and may be punched from the walls of the wire receiving portion (7), mechanically and electrically engage a wire which is pushed into the bore in the wire receiving portion and then pulled in the reverse direction. Internal annular projections or ribs (27) can also be provided in the wire receiving portion (7) of the contact (1) between axially spaced tines (25) to improve the wire gripping capability of the self-terminating wire receiving portion. If the wire is insulated, the tines (25) penetrate the insulation to make electrical contact with the conductor.

In the case of a socket type contact (1) made in accordance with the principles of the invention, the resilient longitudinal fingers (19) forming the socket in the mating portion (5) of the contact taper radially inward toward the ends of the fingers and then flare outward to form a funnel (21) which guides a mating pin type contact (37) into the socket. The internal diameter of the neck (55) between the tapered and flared portions of the resilient socket fingers (19) is smaller than the outer diameter of the mating pin (53) so that the pin is wiped as it is inserted in the socket and is firmly gripped thereby.

BRIEF DESCRIPTION OF THE DRAWINGS

FIG. 1 is an isometric view of a socket type contact made in accordance with the principles of the invention and with a portion cut away for clarity.

FIG. 2 is a longitudinal sectional view through a portion of a pair of connectors showing the socket contact of FIG. 1 retained in one connector and a pin type contact made in accordance with the principles of the invention retained in the other connector and in mated connection with the socket contact.

FIG. 3 is an isometric view of a stamping used to make the socket contact of FIG. 1.

DESCRIPTION OF THE PREFERRED EMBODIMENT

FIG. 1 illustrates a socket type contact 1 made in accordance with the teachings of the invention by rolling a sheet of electrically conductive, resilient material, such as a beryllium copper alloy, to form a tubular body 3 having a mating portion 5 at one end and a wire receiving portion 7 at the other end with a longitudinal seam 9 extending the length thereof seam 9 extends the entire length of the contact. The spaced portion of seam 9 defines a longitudinal gap extending through at least said center section 11 and tapered sections 13. Intermediate the mating and wire receiving portions is a cylindrical center section 11 having a larger diameter than the end portions and being joined thereto by tapered sections 13. The larger diameter center section and tapered sections create a gap 15 in the longitudinal seam 9 which permits the center section to be compressed like a C spring by the application of a radial force thereto. An annular groove 17 in the cylindrical center section 11 locks the contact 1 in a connector in a manner discussed below.

The mating portion 5 of the contact 1 illustrated in FIG. 1 includes a pair of resilient, longitudinal fingers 19 which cooperate to form a socket. The fingers 19 taper radially inward toward the end of the tubular body 3 and then flare outward to form a funnel shaped guide 21 for a pin type contact which may be inserted in the bore of the tubular body.

The wire receiving portion 7 of the contact 1 illustrated in FIG. 1 includes a tubular section 23 having a number of tines 25 projecting radially inward and axially toward the center section 11 from the inner surface thereof. The tines 25 can conveniently be punched from the walls of tubular section 23 as illustrated. In addition, annular rings 27 are provided on the interior wall of the tubular section 23 between axially spaced tines 25. A wire is inserted into the tubular section 23 in the direction of the center section 11, and then pulled back so that the tines 25 dig into the wire to mechanically grip the wire and to make electrical contact therewith. If the wire is insulated, the tines will penetrate the insulation to make electrical contact with the conductor in the wire. The annular rings 27 are forced into engagement with the wire as it is pulled back against the tines thereby helping to grip the wire.

The wire receiving portion shown and described is self-terminating in that no other steps are required to connect the wire to the contact other than inserting it and pulling back on it. Other types of terminations can be provided on the contact, such as a standard crimp termination, a "B" tab crimp termination or an open termination for soldering or welding the wire to the contact.

FIG. 2 illustrates how the socket type contact 1 of FIG. 1 is retained in a connector and how it mates with a complementary pin type contact. Only a portion of the dielectric 29 of a suitable connector 31 is shown since the remaining details of the connector are unimportant to an understanding of the present invention. A bore 33 through the dielectric 29 is provided with an annular projection 35 intermediate the ends thereof which serves as a retention ring for the contact 1. The center section 11 of the contact 1 is larger in diameter than the bore 33 in the dielectric, however, the center section is compressed through the wedging action of the bore 33 against the tapered section 13 at one end of the center section as the contact slides into the bore 33. When the annular groove 17 in the center section 11 is aligned axially with the retention ring 35, the center section 11 expands to seat the groove 17 over the retention ring 35 and to bear against the walls of bore 33 on either side of the retention ring 35 to give the connection between the contact 1 and the dielectric 29 stability. The contact 1 can be removed from the connector by inserting into the bore 33 from either the front or back of the connector a cylindrical tool (not shown) having an outer diameter which is smaller than the inner diameter of the retention ring 35. The tool slides up the adjacent tapered section 13 of the contact and compresses the center section 11 so that the contact can then be pushed out of either the front or back of the connector. Thus the contact is front or rear insertable, front or rear releasable and front or rear removable. The cylindrical tool can be used if desired to assist in seating the groove 17 over the retention ring 35 when installing the contact in the connector as well as in removing the contact.

As shown in FIG. 2 the socket contact 1 can be mated with a pin type contact 37. The pin type contact 37 is similar in construction to the socket type contact 1, having an enlarged center section 39 which may be compressed to slide the contact into a bore 41 in the dielectric 43 of a second connector 45 until an annular groove 47 in the center section 39 is in alignment with an annular retention ring 49 in the bore 41. The contact 37 also is provided with a wire receiving portion 51 at the one end which may be of any of the types discussed above in connection with the contact 1. The contact 37 differs from the contact 1 in that the mating portion is in the form of a chamfered pin 53 which is received in the socket of the contact 1. The cantilevered resilient fingers 19 of the socket contact 1 form a neck 55 between the tapered portion of the fingers and the flared out funnel portion 21 which is of smaller internal diameter than the outer diameter of the pin 53 on contact 37 such that the pin 53 is wiped by the neck of the fingers as its slides into the socket and is held firmly thereby. At the same time the funnel portion 21 of the socket contact 1 guides the pin into alignment with the narrow neck 55.

The contact 1 is rolled from a blank 57 as shown in FIG. 3, stamped from a sheet of a resilient, electrically conductive material such as a beryllium copper alloy sides 8′ and 9′ form the slit 8 and 9, respectively when the contact is formed as shown in FIG. 1. The blank 57 is stamped over a projection to form a channel 59 which becomes the annular groove 17 in the center section of the contact 1. The contact 37 is formed in a similar manner except that the portions forming the pin are narrower.

While the preferred embodiments of the invention have been described in detail, it will be apparent to those skilled in the art that various modifications and alternatives to the details disclosed herein could be developed which would still fall fully within the scope of the invention. Accordingly, the particular arrangements illustrated and described are meant to be illustrative only and not as limiting on the scope of the invention which is to be given the full breadth of the appended claims and all equivalents thereof.

What is claimed is:

1. An electrical contact stamped and formed into a tubular body from a single sheet of metal, said tubular body comprising:

a longitudinal seam extending the entire length thereof;

a mating portion at one end, said mating portion having a longitudinal slit extending from one end thereof and located opposite from the longitudinal seam, said slit and said seam defining two resiliently deflectable fingers at said mating end;

a wire receiving portion at the other end;

a center section having a larger diameter than the mating and wire receiving portions thereof; and tapered portions extending radially inwardly from said center section to said mating and wire receiving portions respectively, said center section having an annular groove in the outer surface thereof; and a single longitudinal opening in said tapered portions and said center section aligned with said seam so that said center section may be compressed like a C spring, whereby when said contact is inserted into a bore having a diameter slightly smaller than the diameter of said contact center section, the opposite sides of said opening rotate towards each other to reduce the diameter of the center section.

2. The electrical contact of claim 1 wherein said mating portion tapers radially inwardly towards the mating end of the tubular body.

* * * * *